US010971323B1

(12) United States Patent
Hansson et al.

(10) Patent No.: US 10,971,323 B1
(45) Date of Patent: Apr. 6, 2021

(54) SEMICONDUCTOR X-RAY TARGET

(71) Applicant: Excillum AB, Kista (SE)

(72) Inventors: Björn Hansson, Kista (SE); Andrii Sofiienko, Kista (SE); Ulf Lundström, Kista (SE)

(73) Assignee: EXCILLUM AB, Kista (SE)

( * ) Notice: Subject to any disclaimer, the term of this patent is extended or adjusted under 35 U.S.C. 154(b) by 185 days.

(21) Appl. No.: 16/468,374

(22) PCT Filed: Dec. 15, 2017

(86) PCT No.: PCT/EP2017/083081

§ 371 (c)(1),
(2) Date: Jun. 11, 2019

(87) PCT Pub. No.: WO2018/109176

PCT Pub. Date: Jun. 21, 2018

(30) Foreign Application Priority Data

Dec. 16, 2016 (EP) ..... 16204831

(51) Int. Cl.
*H01J 35/08* (2006.01)
*H01J 35/10* (2006.01)
(Continued)

(52) U.S. Cl.
CPC ..... *H01J 35/13* (2019.05); *H01J 35/106* (2013.01); *H01J 35/112* (2019.05); *H01J 35/116* (2019.05); *H01J 35/147* (2019.05); *H01J 35/153* (2019.05); *H01J 35/30* (2013.01); *H05G 1/52* (2013.01); *H05G 1/70* (2013.01);
(Continued)

(58) Field of Classification Search
None
See application file for complete search history.

(56) References Cited

U.S. PATENT DOCUMENTS 6,560,315 B1 5/2003 Price et al.
9,390,881 B2 * 7/2016 Yun ..... H01J 35/08
(Continued)

FOREIGN PATENT DOCUMENTS

DE 10320858 A1 11/2003
JP 2006260995 A 9/2006
WO 2015034791 A1 3/2015

OTHER PUBLICATIONS

International Preliminary Report on Patentability (PCT/IPEA/4090) dated Nov. 22, 2018, by the Japanese Patent Office as the International Preliminary Examining Authority for International Application No. PCT/EP2017/083081.
(Continued)

*Primary Examiner* — Thomas R Artman
(74) *Attorney, Agent, or Firm* — Buchanan Ingersoll & Rooney P.C.

(57) ABSTRACT

A solid X-ray target for generating X-ray radiation is disclosed. The X-ray target includes at least one material selected from a list including trivalent elements; and at least one material selected from a list including pentavalent elements, wherein a first one of the materials is capable of generating the X-ray radiation upon interaction with an electron beam, and a second one of the materials forms a compound with the first one of the materials. An X-ray source including such an X-ray target and an electron source is also disclosed.

11 Claims, 5 Drawing Sheets

(51) Int. Cl.

| | |
|---|---|
| ***H01J 35/12*** | (2006.01) |
| ***H01J 35/14*** | (2006.01) |
| ***H01J 35/30*** | (2006.01) |
| ***H05G 1/52*** | (2006.01) |
| ***H05G 1/70*** | (2006.01) |

(52) U.S. Cl.
CPC . *H01J 2235/081* (2013.01); *H01J 2235/1204* (2013.01); *H01J 2235/1233* (2013.01); *H01J 2235/1262* (2013.01)

(56) References Cited

U.S. PATENT DOCUMENTS

| | | | | |
|---|---|---|---|---|
| 9,874,531 | B2 * | 1/2018 | Yun | A61B 6/4291 |
| 2008/0019481 | A1 | 1/2008 | Moy | |
| 2008/0308814 | A1 | 12/2008 | Nakahata et al. | |
| 2015/0110252 | A1 * | 4/2015 | Yun | G21K 1/06 378/138 |
| 2015/0260663 | A1 * | 9/2015 | Yun | G21K 1/02 378/36 |

OTHER PUBLICATIONS

International Search Report (PCT/ISA/210) and Written Opinion (PCT/ISA/237) dated Apr. 11, 2018, by the Japanese Patent Office as the International Searching Authority for International Application No. PCT/EP2017/083081.

* cited by examiner

SEMICONDUCTOR X-RAY TARGET

TECHNICAL FIELD

The invention disclosed herein generally relates to generation of X-ray radiation. In particular, it relates to a solid X-ray target for generating X-ray radiation.

TECHNICAL BACKGROUND

X-ray radiation may be generated by letting an electron beam impact upon a solid anode target. Traditionally, the solid anode target is formed of an element with a high atomic number, such as tungsten or copper, in order to maximize the X-ray yield. However, in practice, the generation of X-ray radiation is often limited by the thermal properties of the solid anode materials. Heat capacity, thermal conductivity and melting point are examples of thermal properties which, when limited, may lead to overheating, target consumption and a poor control of the quality of the generated X-ray radiation. Trivalent, such as gallium or pentavalent, such as arsenic, pure elements have also been contemplated as solid anode target materials, but their ability to produce X-ray radiation is often limited by their thermal properties.

Furthermore, traditional X-ray targets, such as tungsten or copper targets, produce X-ray radiation that is not suitable for studying several types of material systems, e.g. silicon based systems comprising copper structures.

Even though solid X-ray targets exist in the art today, there is still a need for improved targets for generating X-ray radiation. In particular, there is a need for solid X-ray targets with improved thermal properties.

SUMMARY

It is an object of the present invention to provide a solid X-ray target addressing at least some of the above issues. A particular object is to provide a solid X-ray target provided with improved thermal properties.

This and other objects of the invention are achieved by means of a solid X-ray target having the features defined in the independent claims. Advantageous embodiments are defined in dependent claims.

Hence, according to a first aspect, there is provided a solid X-ray target for generating X-ray radiation, comprising at least one material selected from a list including trivalent elements; and at least one material selected from a list including pentavalent elements. A first one of said materials is capable of generating the X-ray radiation upon interaction with an electron beam, and a second one of said materials forms a compound with the first one of said materials. The solid X-ray target furthermore comprising a first region including the compound formed of the first and second material; and a second region (120) supporting the first region; wherein the first region is at least one of: provided in the form of a layer on the second region, and at least partly embedded in the second region; and wherein heat conduction between the first and second region is dominantly phonon heat conduction.

According to a second aspect, there is provided an X-ray source, comprising an X-ray target as defined in the first aspect of the invention; and an electron source operable to generate the electron beam interacting with the X-ray target to generate X-ray radiation.

According to a third aspect, there is provided an X-ray source comprising an X-ray target, an electron source operable to generate an electron beam interacting with the X-ray target to generate X-ray radiation with an energy within the range 9 to 12 keV. The X-ray target furthermore comprises a first element selected from a list including trivalent elements; and a second element selected from a list including pentavalent elements forming a compound with said first element.

The inventors have surprisingly found that a solid X-ray target according to the above aspects, wherein a first one of the materials is selected for its capability to generate X-ray radiation upon interaction with an electron beam and another one of the materials is selected for is ability to form a compound with the first material, is capable of emitting characteristic X-ray radiation at a suitable energy as well as having excellent thermal properties, such as excellent heat management properties. For example, the trivalent element gallium may be capable of emitting a characteristic X-ray radiation of an energy of 9.3 keV, which may be a suitable energy for an X-ray target. Characteristic X-ray radiation of an energy of about 8-12 keV may be especially advantageous for studying silicon based systems, such as silicon based microelectromechanical systems (MEMS) and integrated circuits. In particular, radiation of about 10 keV may be employed for analysing silicon based systems comprising copper structures. Copper is known to absorb characteristic X-ray radiation of an energy of about 10 keV, whereas silicon is transparent to such radiation. This provides for X-ray imaging having good contrast between the silicon and copper in the system. Such contrast is more difficult to achieve by for example traditional copper targets, since the characteristic X-ray radiation generated by such targets are generally not suited for that combination of materials.

However, the relatively low melting point (303 K) of Ga may be a drawback for use in solid X-ray target applications. By forming a compound between gallium and a pentavalent element, for example nitrogen, a solid X-ray target capable of emitting a characteristic X-ray radiation of an energy of 9.3 keV as well as having a melting point of 2773 K may be achieved. Furthermore, this compound, gallium nitride, is known for having a thermal conductivity of 130 $W \cdot m^{-1} \cdot K^{-1}$, which is a considerable improvement over 29 $W \cdot m^{-1} \cdot K^{-1}$ known for pure gallium. As a further example, the trivalent element boron has a low characteristic X-ray energy of 0.18 keV, which may be less suitable for X-ray generation. However, boron has good heat management properties, such as a high melting point of 2349 K. By forming a compound of boron and a pentavalent element, for instance arsenic which is capable of emitting characteristic X-ray radiation at an energy of 10.5 keV, a solid X-ray target capable of emitting a characteristic X-ray radiation of an energy of 10.5 keV and a melting point of 2300 K may be achieved. As a still further example, a compound formed of gallium and arsenic may be used in a solid X-ray target according to the invention. Such a compound may be capable of emitting characteristic X-ray radiation at both an energy of 9.3 keV and an energy of 10.5 keV. The melting point of gallium arsenide is 1511 K, which is significantly higher than the melting point for gallium (303 K) as well as the sublimation point for arsenic (887 K). Yet another example of a compound according to the invention is gallium phosphorous. As mentioned above, gallium is capable of generating X-ray radiation at a suitable energy, but has poor heat management properties. Phosphor is also capable of generating X-ray radiation at a suitable energy, and also has poor heat management properties, such as low melting point (317 K) and a low thermal conductivity (0.2 $W \cdot m^{-1} \cdot K^{-1}$). Surprisingly, the compound gallium phosphorous formed by gallium and phosphor are not only capable of generating X-ray radiation at a suitable energy, but it also has good heat management properties, such a high melting point (1730 K) and a high thermal conductivity (110 $W \cdot m^{-1} \cdot K^{-1}$).

The compound may furthermore comprise more than two elements, such as e.g. three elements. The compound may for example comprise two trivalent elements and one pentavalent elements. An example of a compound comprising three elements suitable in an X-ray target of the present invention is indium gallium nitride.

A further advantage associated with the first aspect of the invention is that trivalent and pentavalent elements typically may form so called III-V-semiconductor compounds. Such compounds may have a phonon dominated heat conduction. A "phonon" should be understood as a quantum of energy associated with a compressional wave or vibration in a crystal lattice. In crystalline solids, phonon heat conduction may be one of two dominating mechanisms for heat conduction, the other being electronic heat conduction. Electronic heat conduction may typically be the dominating mechanism in metals. For heat to conduct well between materials in touching contact with each other, it may be preferable if the material have the same dominating mechanism for heat conduction. For example, the heat conduction may be better between a material wherein the dominating heat conduction mechanism is phonon heat conduction and another material wherein the dominating heat conduction mechanism is phonon heat conduction as compared to a material wherein the dominating heat conduction mechanism is electronic heat conduction.

As used herein, the term "trivalent element" may refer to any element of group 13 in the periodic table, with the exception of the uncharacterized and unstable element 113 and the possible exception of thallium. The trivalent elements may in the present disclosure be boron, aluminium, gallium, indium, or thallium. The trivalent element may also be boron, aluminium, gallium, or indium. In some examples, the trivalent element may be selected from a list consisting of boron, gallium, and indium. The term "trivalent element" refers to the fact that these elements have three valence electrons.

The term "pentavalent element" in the present disclosure should be understood as any element of group 15 of the periodic table, with the exception of the uncharacterized and unstable element 115. The pentavalent elements may in the present disclosure be nitrogen, phosphorous, arsenic, antimony or bismuth. The term "pentavalent element" refers to the fact that these elements have five valence electrons. In some examples, the pentavalent element is selected from a list consisting of nitrogen, arsenic, and phosphorous.

As used herein, the term solid target or solid X-ray target may refer to any solid material or compound capable of emitting X-ray radiation upon interaction with impinging electrons. The solid target may be e.g. a sheet or a foil, it may be homogenous or provided on a substrate, and may further be configured as a stationary target or a rotating target. The solid target may be formed of a compound formed by at least one trivalent material and at least one pentavalent material.

The term "compound" may refer to a substance formed from two or more elements chemically united, preferably in fixed positions. The compound is preferably a solid compound, more preferably a crystalline compound. A crystalline compound may be a solid consisting of a symmetrical, ordered, three-dimensional aggregation of atoms. Crystalline compounds may have a heat conduction dominated by either electronic heat conduction or phonon heat conduction. In the present disclosure, it is preferred if the compound has a heat conductivity dominated by phonon heat conduction. A specific type of compounds having a phonon dominated heat conductivity is semiconductor compounds. Advantageously, the trivalent and pentavalent materials disclosed herein typically form semiconductor compounds together. The compounds formed in the present disclosure typically has a phonon dominated heat conduction.

The term "heat management properties" in the present disclosure is generally supposed to denote a combination of properties which makes the materials more or less suitable to handle the heightened temperature in the target caused by the interaction between the target and the impinging electron beam. A high temperature in the target may cause damage to the target and have a negative influence on the amount of X-ray radiation generated by the target. In particular, it is important that the target does not melt during operation, and thus a high melting point is desired. It is furthermore preferred that the target can dissipate heat in a suitable fashion to allow the operating temperature of the target to be maintained at a relatively constant level. Hence, a high thermal conductivity and specific heat capacity is preferred.

Further, by interaction between the electron beam and the target is hereby meant the particular way in which matter of the target and the electrons of the electron beam affects one another. Specifically, generation of X-ray radiation is meant.

In some embodiments, the first one of said materials may have an atomic number exceeding 30. Typically, materials having an atomic number exceeding 30 exhibits a capability of efficiently emitting characteristic X-ray radiation of a desired energy, and further provides a sufficiently high cross section for the interaction with impinging electrons of the electron beam. Examples of materials having an atomic number exceeding 30 are gallium, arsenic, indium, antimony and bismuth. Materials having an atomic number below 30 typically exhibits a capability of emitting characteristic X-ray radiation at an energy that is not suitable for an X-ray target. In general, the characteristic X-ray radiation produced by materials having an atomic number below 30 has an energy that is too low to be suitable.

In some embodiments, the first one of said materials may be capable of emitting a characteristic X-ray radiation of an energy exceeding 1 keV. There are various applications for an X-ray target according to the present invention. Such applications may be, but are not limited to, for example X-ray photoelectron spectroscopy (XPS), X-ray fluorescence (XRF), X-ray diffraction (XRD) and X-ray imaging. Depending on the application, different characteristic X-ray energies are of particular interest. For example, in surface sensitive applications such as XPS it may be preferable if the X-ray target is capable of emitting characteristic X-ray radiation of an energy of 1-5 keV, such as 1-3 keV. In for example XRD, rather low energies may be preferable in order to increase the diffraction angles. However, high energies may also be preferable in order to decrease the scattering angles. In XRF, a wide range of energies may be preferred, depending on the absorption edges of the materials to be studied. In some embodiments, it may be preferred if the first one of said materials is capable of emitting a characteristic X-ray radiation of an energy in the range of 0.2-0.6 keV, such as 0.28-0.53 keV. This is especially advantageous if the studied sample is a biological sample, such as a cell.

According to some embodiments, the compound may form a crystalline structure. Preferably, the compound may form a crystalline solid wherein heat conduction is dominantly phonon heat conduction. The compound advantageously comprises 2-4 elements, such as 2 elements, such as 3 elements.

According to an embodiment, the second material may be boron. Boron is a material that may exhibit a poor ability to emit characteristic X-ray radiation at a desired energy. However, Boron has excellent heat management properties such as a high melting point and a high specific heat capacity. Boron may readily form compounds with pentavalent elements. The compounds formed may be III-V-semiconductor compounds. Typically, the compounds formed by boron and pentavalent elements may have a heat conduction that is dominantly phonon heat conduction.

In some embodiments, the second material may be nitrogen. Nitrogen is a material that may exhibit a poor ability to generate characteristic X-ray radiation at a suitable energy. Furthermore, nitrogen is in gaseous form at room temperature. However, nitrogen can form compounds with several trivalent elements. These compounds have excellent heat management properties such as high thermal conductivity, high melting point, and high specific heat capacity. The compounds formed may be III-V-semiconductor compounds. Typically, the compounds formed by nitrogen and trivalent elements may have a heat conduction mechanism that is phonon dominated.

In an embodiment, the compound may be formed of a material selected from a list including gallium nitride, indium nitride, boron arsenide, indium arsenide, gallium phosphide, indium gallium nitride and gallium arsenide. In some examples, the compound is selected from a list including gallium nitride, boron arsenide, indium arsenide, gallium phosphide, indium gallium nitride and gallium arsenide. Gallium, indium, and arsenic are all capable of emitting characteristic X-ray radiation at suitable energies, such as above 1 keV. However, their heat management properties make it difficult to handle the elemental form of these materials in X-ray target applications. The inventors have realized that by forming a compound of a material capable of emitting characteristic X-ray radiation at suitable energies and a material not capable of emitting characteristic X-ray radiation at suitable energies, an excellent combination of X-ray emission properties and heat management properties can be achieved.

In some embodiments, the X-ray target may comprise a first region including the compound formed of the first and second material; and a second region supporting the first region; wherein heat conduction between the first and second region is dominantly phonon heat conduction. The compounds of the present invention may be difficult to produce in bulk. Therefore, according to the invention, it may be advantageous if the X-ray target further comprises a first region of the compound, and a second region supporting the first region. The second region may provide the first region with mechanical support. Furthermore, the second region may preferably act as a means of dissipating heat from the first region. Heat is produced in the first region when the first region interacts with the electron beam. By providing the target with a second region capable of dissipating heat, more electrons can interact with the first region without causing the target to overheat. Hence, a larger amount of X-ray radiation may be produced by the interaction between the target and the impinging electrons. The first and second region may be separated by an edge. By the term "edge" should be understood e.g. a line or interface along which two surface regions of the target meet, or a surface step defined by the interface between the first region and the second region of the target. It will be appreciated that the target may comprise at least two edges extending along different directions on the surface of the target. Alternatively, or additionally, a single edge may extend along more than one direction, i.e., along a curved or bent path The heat conduction between the first and second region may dominantly be phonon heat conduction. Preferably, the heat conduction in the first and second regions are dominantly phonon heat conduction. Materials having the same dominating mechanism will typically have a low thermal boundary resistance between each other. A low thermal boundary resistance may increase the thermal conduction between the materials. This may allow the second region to dissipate heat from the first region in an efficient manner. The second region preferably comprises crystalline solids, such as non-metallic crystalline solids. The second region may e.g. be formed of materials comprising elements having an atomic number below 15, such as beryllium oxide or carbon, e.g. in the form of diamond. The materials in the second region are preferably not capable of generating X-ray radiation at a suitable energy and efficiency.

In some embodiments, the first region may be at least partially embedded in the second region. The first region may be embedded in the second region by means known in the art, such as by photolithographic patterning methods.

According to some embodiments of the present invention, first region may form part of a layer and the second region forms part of a substrate, and wherein the layer is arranged on the substrate. Some of the compounds comprised by the first region of the invention are difficult to manufacture in bulk. Therefore, it may be advantageous to deposit the first region as layer on the second region acting as a substrate. The first region may preferably be deposited as a thin film. Means for depositing thin films on a substrate are well known in the art and may be, but are not limited to, chemical vapour deposition (CVD) and physical vapour deposition (PVD). The first region may preferably be deposited in an epitaxial manner. The term "epitaxial" in the present disclosure is supposed to denote that the deposited material forms a crystalline layer having one well-defined crystal orientation with respect to the substrate crystal structure.

In some embodiments of the present invention, the first region may comprise gallium nitride and/or the second region may comprise beryllium oxide or carbon, such as diamond. Gallium nitride as well as beryllium oxide or carbon, such as diamond have a heat conduction mechanism which is phonon dominated. Thus, the heat conduction between gallium nitride and beryllium oxide or carbon, such as diamond is dominantly phonon heat conduction, which provides the first region and the second region with a low thermal boundary resistance. A low thermal boundary resistance may generally correlate with a high heat conductivity. The second region may therefore efficiently dissipate heat from the first region, allowing for a larger number of electrons to interact with the target without overheating the target. Furthermore, gallium nitride combines a capability to generate characteristic X-ray radiation with good heat management properties.

In some embodiments, the X-ray target according to the invention may comprise a first region including the compound formed of the first and second material; and a second region; wherein the first region and the second region have different capability to generate X-ray radiation upon interaction with an electron beam. By using a target of two distinct regions in terms of X-ray generating capacity, the difference can be used for extracting information about the electron beam characteristics.

In some embodiments, the X-ray target of the present invention may comprise a first region including the compound formed of the first and second material and a second region arranged to act as a cover for the first region. When the first region interacts with the impinging atoms, some degree of evaporation is present. Such an evaporation is generally undesirable since it may damage the surface finish of the target. A target having poor surface finish may suffer from self-absorption of emitted X-rays. To alleviate the undesirable evaporation, the second region may be arranged to act as a cover for the first region.

According to some embodiments, the X-ray target may be a transmission target or a reflection target. The term "transmission target" generally denotes an X-ray target arranged such that the majority of the X-ray radiation may be emitted from the target in the same general direction, or from the same side, as the electron beam impinges the target. The term "reflection target" should be understood as an X-ray target arranged such that the majority of the X-ray radiation may be emitted from the target in the opposite general direction as the electrons in the electron beam are moving. Reflection targets are generally thicker than transmission targets. Reflection targets are generally thick enough so that X-ray radiation generated in the same direction as the incoming electrons are absorbed by the target material before they can be emitted from the target. The target may furthermore be a stationary target or a moving target, e.g. a so called rotating anode.

A sufficiently thick target may be provided with cooling channels, e.g. for accommodating or transporting a coolant, or be clamped to an actively cooled surface, thus further enhancing the thermal management properties.

According to some embodiments, the X-ray system disclosed herein may furthermore comprise an X-ray focusing device.

According to some embodiments, the x-ray source may further comprise a target holder arranged to fixate said target. The target holder may comprise a path for a coolant arranged to remove excess heat from said target.

According to some embodiments, the target holder furthermore comprises at least of a heat exchanger, a cooling flange, a Peltier element, and a fan arranged to remove heat from a coolant.

According to some embodiments, the X-ray system disclosed herein may furthermore comprise an electron-optical means for scanning the electron beam over the edge, a sensor adapted to measure a time evolution of a quantity indicative of the interaction between the electron beam and the first region and between the electron beam and the second region as the electron beam is being scanned over the edge, and a controller operably connected to the sensor and the electron-optical means and adapted to determine a lateral extension of the electron beam along the scanning direction, based on the measured time evolution of the quantity and a scanning speed of the electron beam.

By the term "a quantity indicative of the interaction" should be understood any quantity that is possible to measure or determine, either directly or indirectly, and which comprises information that can be used for determining or characterising the interaction between the electron beam and the target. Examples of such quantities may include an amount of generated X-ray radiation, a number of electrons passing through the target or being absorbed by the target, a number of secondary electrons or electrons being backscattered from the target, heat generated in the target, light emitted from the target, e.g. due to cathodoluminescence, and electric charging of the target. The quantity may also refer to brightness of the generated X-ray radiation. The brightness may e.g. be measured as photons per steradian per square millimetre at a specific power or normalized per W. Alternatively, or additionally the quantity may relate to the bandwidth of the X-ray radiation, i.e., the flux distribution over the wavelength spectrum.

The term "lateral extension" may refer to the shape, width or area of a cross section of the electron beam, the beam spot, or a two-dimensional projection of the electron beam onto the target. In the context of the present application the term may be interchangeably used with width, spatial distribution or shape of the beam spot. Furthermore, if the lateral extension of the beam spot is determined for a plurality of focus settings a three-dimensional spatial distribution of the electron beam may be estimated.

The quantity indicative of the interaction between the electron beam and the target may be measured by means of a sensing means.

According to an embodiment, the sensing means may comprise an ammeter for measuring the current absorbed by the target. An advantage with this embodiment is that the absorbed current may indicate a measure of the thermal power absorbed by the target. Thus, a control circuit may be implemented to ensure that the target is not thermally overloaded.

According to an embodiment, the electrons scattered off the target, a process known as backscattering, may be measured. This may be achieved by means of a backscattering detector that e.g. may be arranged in front of the target (i.e., an upstream side relative to the electron beam) to not interfere with the trajectory of X-rays. Backscattered electrons may be distributed over a relatively large solid angle (half a sphere) whereas any sensor may collect electrons from some finite part of this solid angle.

According to an embodiment, the amount of generated X-rays may be measured. An advantage with this embodiment is that the size of the X-ray spot may be determined rather than the size of the electron beam spot. Furthermore, the contrast that can be attained between the first and the second region could be expected to be higher when observing the emitted X-ray radiation; a factor of the order five to ten have been observed, as compared to a contrast in the order of a few percent when measuring current (either in the target or backscattered). Measuring the X-ray radiation instead of the current generated in the target allows for the target to be grounded and the X-ray detector or sensor to be arranged external to the housing.

According to an embodiment, an intensity of the electrons may be adjusted based on the determined lateral extension such that a power density supplied to the target is maintained below a predetermined limit. The predetermined limit or threshold may be selected to reduce the risk of local overheating of the target, which may lead to damages such as melting of the target material and generation of debris. Local overheating may be affected by e.g. the spot size and the total current of electrons impinging the target, or, in other words, the power density in terms of impinging electrons per area unit of the target exposed to the beam spot. The power density may therefore be adjusted by varying the energy or intensity of the electron beam, and/or by varying the spot size on the target.

The total power supplied by the electron beam may be measured or given from the electron source and combined with the determined spot size or width so as to calculate the power density within the electron spot, and/or per volume of the target (e.g. measured as $W/m^3$). Once the power density is estimated, the result can be compared to a predetermined threshold value (e.g. stored in a lookup table) and supplied in a feedback loop back to the control circuitry. In one example, the electron-optical means may vary the width of the electron beam, and in another example the energy or power of the electron beam may be adjusted. The power distribution may be used for determining a peak temperature, and thus the vapour pressure, in the target material to reduce the risk for thermally induced damages (caused by e.g. sublimation or melting of the target material).

The electron-optical system may comprise an arrangement of aligning means, lenses and deflection means that are controllable by signals provided by the controller. The aligning means, deflection means, and lenses may comprise electrostatic, magnetic, and/or electromagnetic components.

Unless otherwise indicated, the drawings are schematic and not to scale.

DETAILED DESCRIPTION OF EMBODIMENTS

Figure 1:
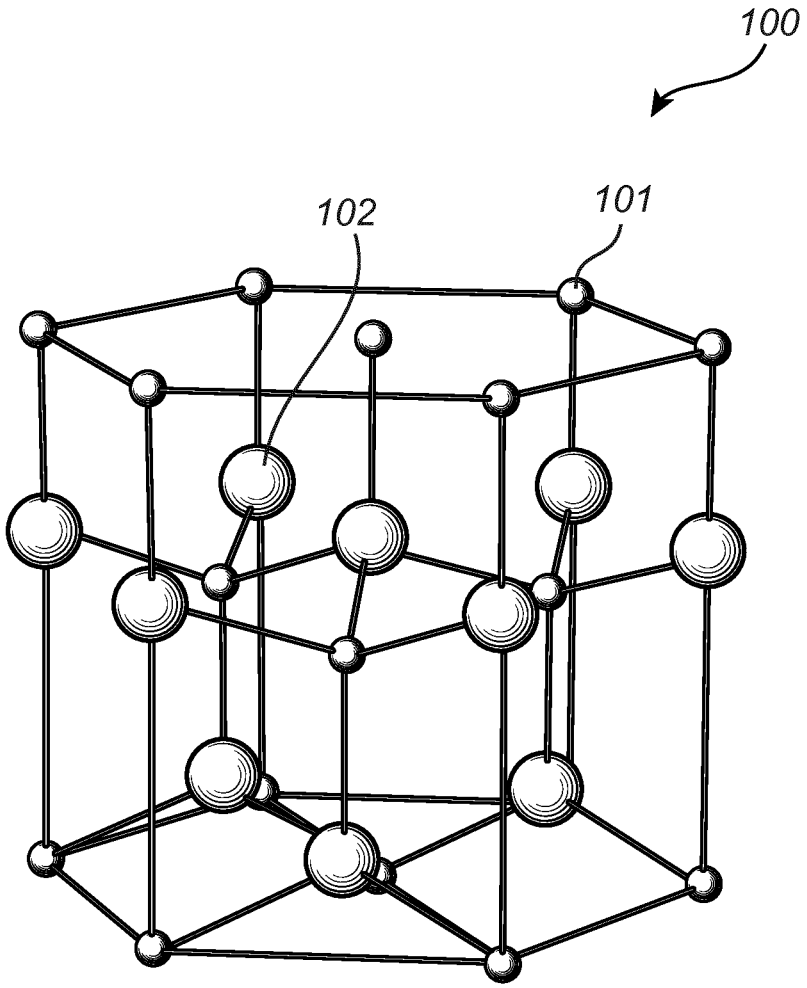
FIG. 1 is a schematic view of portion of an X-ray target according to the invention.

FIG. 1 schematically shows a compound formed of a first material 101 selected from a list including trivalent elements, such as e.g. boron, aluminium, gallium, indium and thallium, and a second material 102 selected from a list including pentavalent materials, such as e.g. nitrogen, phosphorous, arsenic, antimony and bismuth. In the specific, illustrative example of FIG. 1, the first material 101 is represented by gallium and the second element 102 represented by nitrogen. Thus, the illustrated compound is gallium nitride (GaN). GaN is a binary III-V semiconductor material arranged in a tetrahedral crystal structure. The predominant heat conducting mechanism may be phonon based.

Upon interaction with an impinging electron beam, the gallium may contribute to the X-ray generation by emitting a characteristic X-ray radiation of 9.3 keV, whereas the nitrogen may contribute to improved thermal properties by having formed a compound with the gallium. As already mentioned, by forming a compound such as GaN, the relatively low melting point of gallium (303 K) may be increased to about 2773 K.

Figure 2:
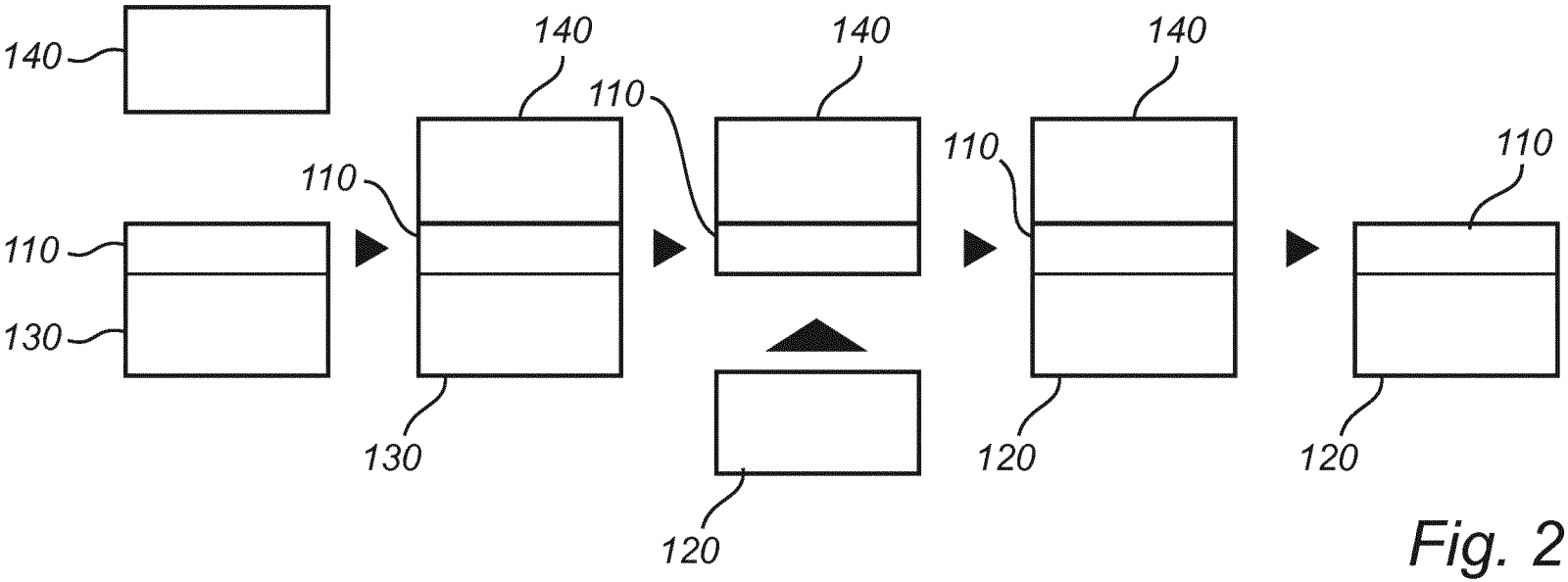
FIG. 2 shows a flow chart of a process for manufacturing an X-ray target according to some embodiments.

FIG. 2 is a flow chart illustrating a process for forming an X-ray target comprising a first region 110, including a compound formed by a trivalent material and a pentavalent material as described above in connection with FIG. 1, and a second region 120 for supporting the first region 110. In the present example, the compound may be formed of gallium nitride, GaN, and the first region 110 may thus be capable of generating X-rays upon interaction with impinging electrons. The second region 120 may be formed of a material primarily selected for its ability to dissipate heat from the first region 110, such as e.g. diamond. However, the skilled person understands that the process described hereinbelow is not limited to gallium nitride and diamond, but may also be useful in embodiments comprising the other compounds and materials disclosed herein.

Gallium nitride (GaN) may be deposited on diamond by a process starting with a commercially available GaN-on-Si wafer, comprising GaN deposited on a silicon substrate 130. In a first step, a temporary carrier 140 may be deposited onto the GaN surface. The temporary carrier 140 may be any suitable material known in the art, such as silicon. Then, the silicon substrate 130 may be removed from the GaN layer by any suitable process, such as chemical etching, leaving one side of the GaN layer exposed. Onto the exposed side of GaN a diamond layer may be deposited by for example chemical vapour deposition (CVD), such as microwave assisted chemical vapour deposition. The diamond may be deposited onto the GaN in an epitaxial manner. Other methods for depositing the diamond may also be used, such as physical vapour deposition (PVD). Optionally, a thin dielectric layer may be deposited onto the GaN before the diamond layer is deposited. Following the deposition of the diamond substrate onto the GaN region, the temporary carrier 140 may be removed by means known in the art, such as chemical etching.

Figure 3A:
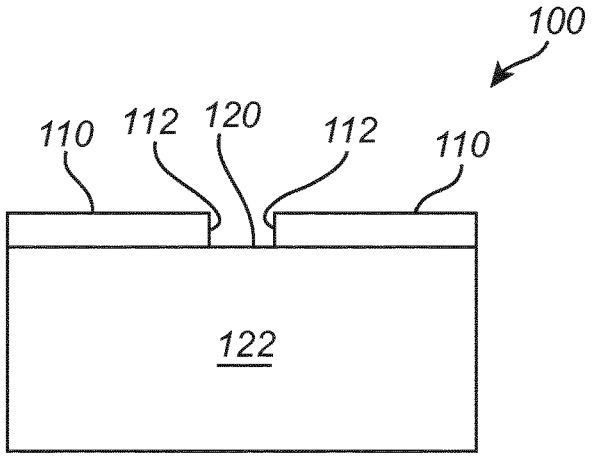
FIG. 3*a* is a cross section of an X-ray target according to an embodiment of the invention.

FIG. 3*a* shows a cross sectional a portion of an X-ray target, which may be similarly configured as the target discussed above in connection with FIG. 2. The first region 110, as indicated in the present example of FIG. 3*a*, may form a layer that may be about 500 nm thick and provided with apertures, such as square, octagon, or circle shaped holes, exposing the underlying substrate 122 forming the second region 120. The apertures may e.g. be formed by means of photo lithography and etching. The substrate may be formed of a material that compared to the material of the first region 110 is more transparent to impinging electrons, and may e.g. be about 100 micrometres thick. The substrate may e.g. comprise diamond, beryllium oxide, or similar light material with low atomic number and preferably high thermal conductivity.

As illustrated in FIG. 3*a*, the first region 110 may comprise an aperture or open region exposing the underlying diamond substrate 122, thereby forming the second region 120 of the target 100.

Figure 3B:
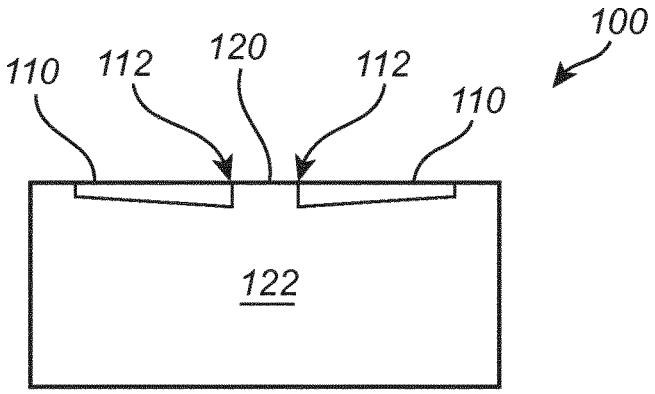
FIG. 3*b* shows an alternative implementation of an X-ray target of the type shown in FIG. 2*a*.

FIG. 3*b* shows another embodiment of a target that may be similarly configured as the one in FIG. 3*a*, but in which the first regions 110 are at least partly embedded in the substrate 122 and have a thickness, in the direction of propagation of the electron beam, that varies along the surface of the target 100. Alternatively, a first region 110 may have a constant thickness that differs from other first regions 110.

Figure 3C:
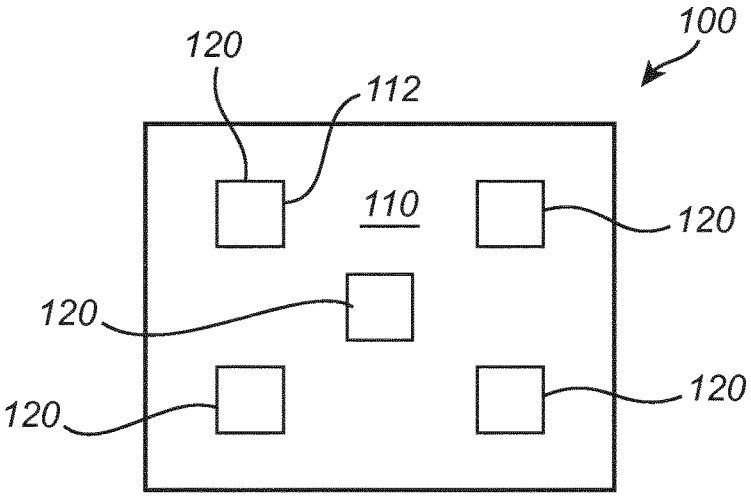
FIG. 3*c* shows a top view of an X-ray target similar to the types shown in FIGS. 2*a* and *b*.

FIG. 3*c* is a top view of a target 100 similar to the ones of FIGS. 2*a* and 2*b*. In this embodiment, the second regions 120 are formed as five rectangles or squares having edges 112 that extend in two substantially perpendicular directions.

Figure 4:
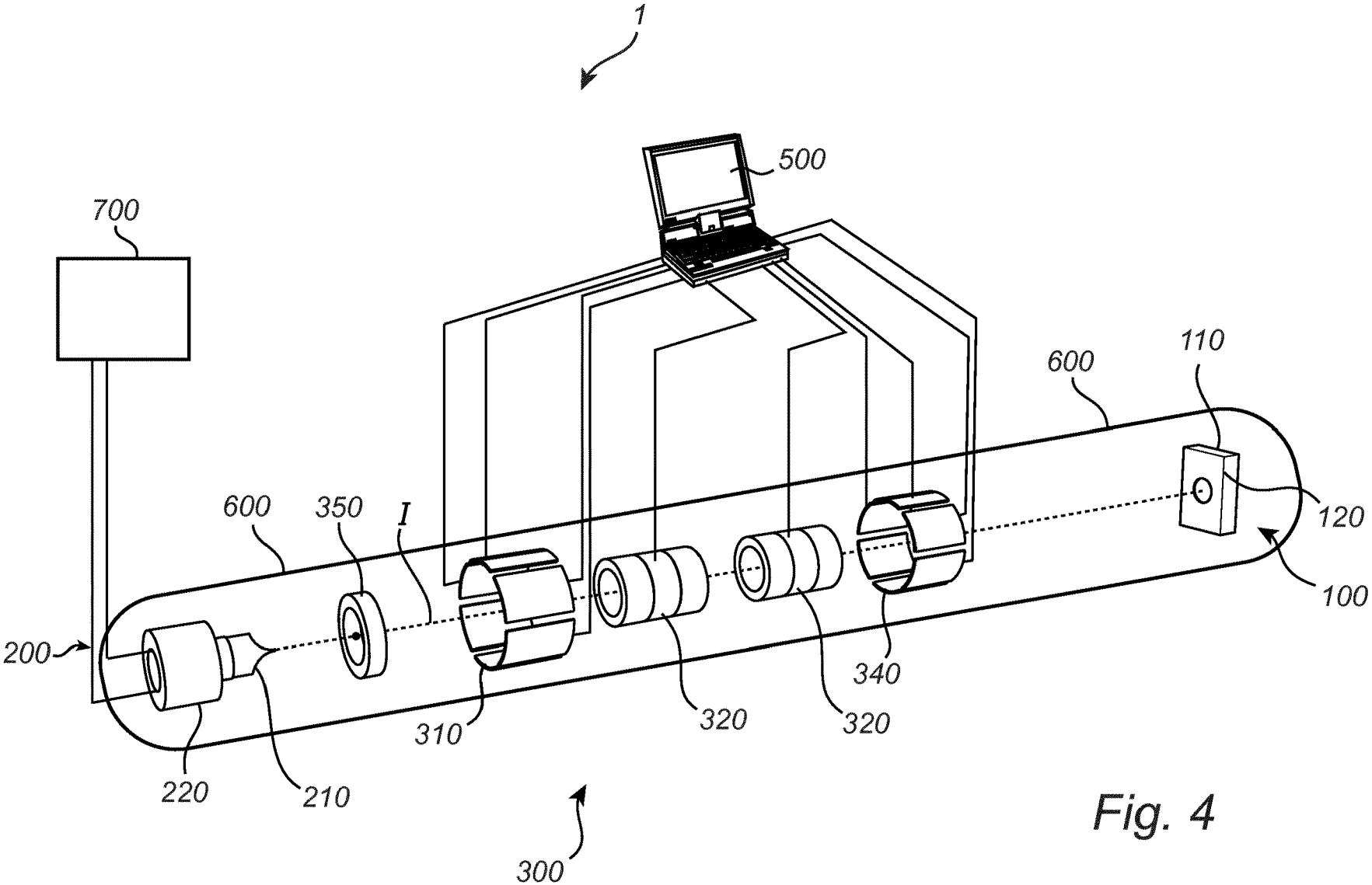
FIG. 4 is a perspective view of an X-ray source for generating X-ray radiation, comprising an X-ray target of the sort shown in any one of the previous figures.

FIG. 4 shows an X-ray source or system 1 for generating X-ray radiation, generally comprising a solid X-ray target 100 of the type described above in connection with the previous figures, and an electron source 200 for generating an electron beam I. This equipment may be located inside a housing 600, with possible exceptions for a voltage supply 700 and a controller 500, which may be located outside the housing 600 as shown in the drawing. Various electron-optical means 300 functioning by electromagnetic interaction may also be provided for controlling and deflecting the electron beam I.

The electron source 200 generally comprises a cathode 210 which is powered by the voltage supply 700 and includes an electron source 220, e.g., a thermionic, thermal-field or cold-field charged-particle source. An electron beam I from the electron source 200 may be accelerated towards an accelerating aperture 350, at which point the beam I enters the electron-optical means 300 which may comprise an arrangement of aligning plates 310, lenses 320 and an arrangement of deflection plates 340. Variable properties of the aligning means 310, deflection means 340 and lenses 320 may be controllable by signals provided by the controller 500. In this embodiment, the deflection and aligning means 340, 310 are operable to accelerate the electron beam I in at least two transversal directions.

Downstream of the electron-optical means 300, the outgoing electron beam I may intersect with the X-ray target 100. This is where the X-ray production takes place, and the location may also be referred to as the interaction region or interaction point. X-rays may be led out from the housing 600, via e.g. an X-ray window 610, in a direction not coinciding with the electron beam I.

Figure 5A:
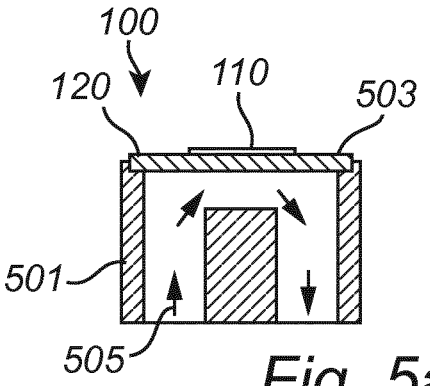
FIG. 5*a* schematically shows a cross section of a target holder according to embodiments of the invention.
Figure 5B:
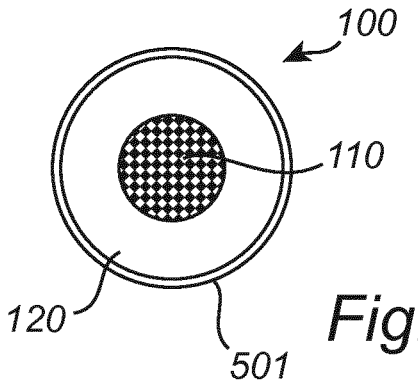
FIG. 5*b* schematically shows a top view of a target holder according to embodiments of the invention.

FIGS. 5*a* and *b* schematically shows an embodiment where the target 100, comprising a first region 110 (e.g. GaN) and a second region 120 (e.g. diamond) is arranged in a target holder 501. The target holder 501 may have any suitable shape or form, such as circular or quadrangular, for providing mechanical support and/or thermal managment. The target holder 501 may be adapted to hold the target 100 such that it can be inpinged by the electron beam I. The target 100 may be positioned in the target holder 501 such that the target is directed towards the inpinging electron beam I. The target may e.g. be positioned at an angle towards the inpinging electron beam I. The target holder may comprise cooling means 505 (illustrated herein as a coolant flow 505) for cooling the target 100. Such cooling means may e.g. employ a circulating cooling fluid (such as water, air or another fluid) in thermal contact with a rear surface of the target 100. The cooling fluid may e.g. be circulated through an inlet and an outlet of the target holder. Alternatively, or additionally the cooling means may comprise a heat sink or heat dissipating means cooling the target by means of e.g. conduction or convection.

The target holder may comprise metal or alloy such as brass or steel. To secure the target to the target holder the substrate may be provided with a metallized surface 503 that may be brazed onto the target holder. The design of the target holder may further be adapted so as to accept thermally induced shape changes of the target without compromising the joint between the target and the target holder. In an exemplary embodiment shown in FIG. 5*a* the target holder comprises a thin walled tube with a recess adapted to the target dimensions. The displacements caused by thermal expansion of the target will deform the tube slightly without breaking the joint between the target and the target holder.

A compact X-ray detector (not shown) may be included to monitor and continuously optimise the position of the electron focal spot. This may be a small solid state detector or other X-ray detecting device.

The X-ray source or system 1 may in some embodiments comprise an X-ray focusing and/or deflection device (not shown). The system encompasses an X-ray focusing device located close to the source to provide a magnified image of the focal spot at controlled varying distances from the source. Options for the X-ray focusing systems may include 1. Micromirrors, using specular reflectivity from a gold or similar coating of highly controlled smoothness (around 10 Å rms), from a circularly symmetric profile. The micromirrors may also have a ellipsoidal profile which gives focused beams of X-rays (such as 300 μm diameter 600 mm from the focal spot). Ellipsoidal profile provides a measured insertion gain of <150 (could be <250). The reason for close coupling is so that a large solid angle of radiation may be collected, but also that the focusing elements may form a magnified image of the focal spot at the sample (low beam divergence but high insertion gain). The micromirrors may also have a paraboloidal profile, which provides a nearly parallel beam, yielding a expected insertion gain of >200.

2. Kirkpatrik-Baez type, comprising Bent plates arranged in combinations of elliptical or parabolic or combination. Allows simple change of mirror profiles to suit different applications.

3. Other possibilities include zone plates, Bragg Fresnel optics and/or multilayer optics.

The distance between the focusing device and the source on the target 100 may be small, such as less than 20 mm, preferably about 10 mm, to ensure close coupling.

The energy spectrum of the generated X-ray radiation will typically comprise both characteristic X-ray radiation (also referred to as line radiation) and Brehmsstralung. Whereas characteristic X-ray radiation comprise discrete energies the Brehmsstralung comprises a broad range of energies. Thus, it may be advantageous to select a focusing device that attenuate X-rays with other energies than the discrete energies of the characteristic radiation capable of projecting a monochromatic X-ray beam onto the sample. Such a focusing device may be realized as a curved multilayer mirror where the distance between the planes are adjusted along the curvature so that the Bragg condition for reflection is fulfilled for the particular X-ray wavelength along the mirrors curvature. This type of mirror may be referred to as a Gobel mirror. When two such mirrors are arranged side by side perpendicular to each other the arrangement may be referred to as a Montel mirror. By providing a curvature with the shape of a paraboloid a collimated or parallel monochromatic beam may be produced. By providing a curvature with the shape of an ellipsoid a focused monochromatic beam may be produced.

Figure 5C:
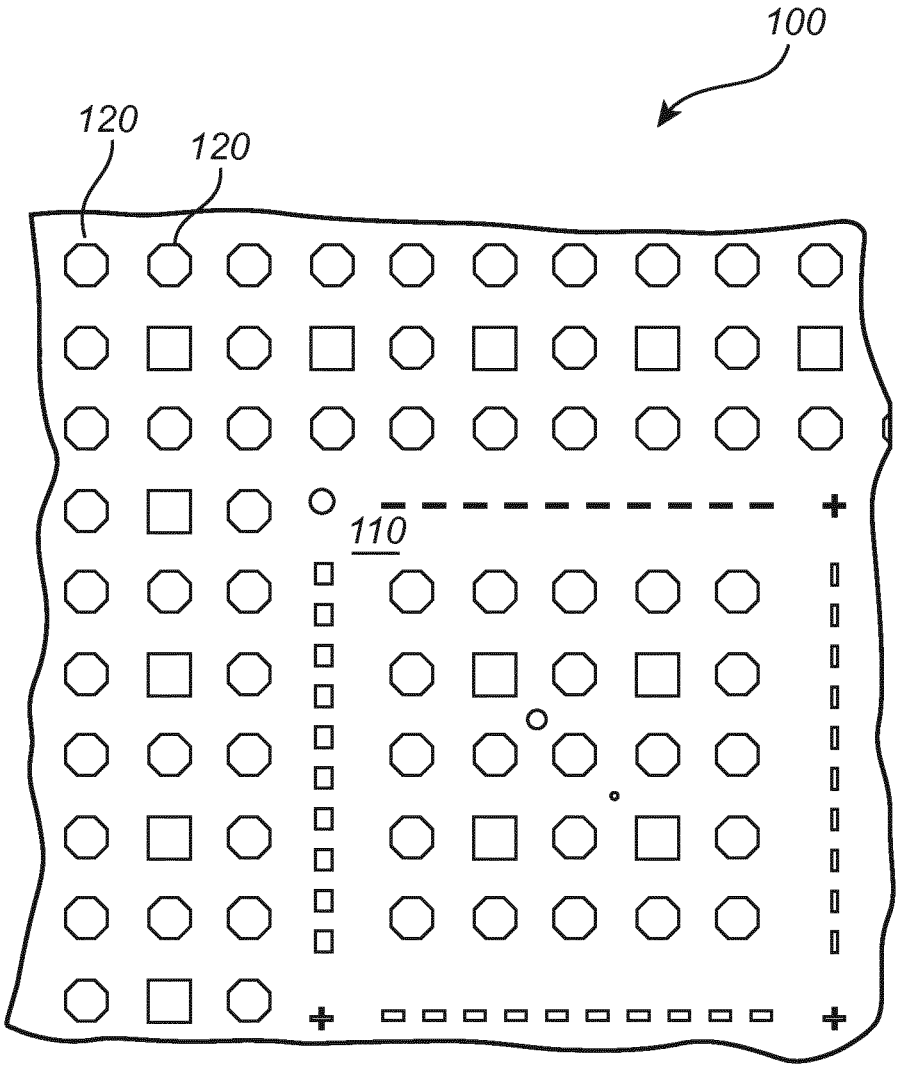
FIG. 5*c* shows a top view of a target according to embodiments of the invention.

FIG. 5*c* shows a portion of a target 100, comprising a plurality of first regions 110 shaped as octagons, squares and rectangles. The octagons may be used for measuring the size of the beam spot in at least three directions, such as 0°, 45° and 90°, thereby allowing for ellipticity of the beam spot (and hence astigmatic effects) to be estimated. This estimated information may e.g. be used for calibration of the electron optics along these three directions.

An electron beam spot Ai may be traversed across a surface of a target 100 in a certain direction. The target may be similarly configured as the targets discussed in connection with FIGS. 3 *a-c* and 5 *c* The beam spot $A_i$, which may have a width $W_x$ in a first direction and $W_y$ in a second direction, may be scanned from a first region 110 of the target, over a first edge (not shown) between the first region 110 and the second region 120 towards the second region 120 of the target 100. Further, the beam spot Ai may continue over the second region 120 towards a second edge 113, perpendicular to the first edge 112, at which the beam spot Ai enters the first region 110 again. The scanning motion may be controlled by a controller and a electron-optical means (not shown).

Since the material of the first region 110 and the second region 120 generally interact differently with impinging electrons—GaN, which may form the first region 110, tends to generate X-rays whereas diamond, which may form the second region 120, tends to have a lower X-ray generating capability—the location of the electron beam spot may be determined by observing its interaction with the target 100. The interaction may e.g. be monitored by measuring a quantity Q such as the amount of generated X-ray radiation, or by measuring a number of electrons that pass through the target 100 or backscatter. The quantity Q may be measured by a sensor.

The resulting quantity Q may be visualized as a sensor signal indicating the measured quantity Q as a function of the travelled distanced on the surface of the target 100 for backscattered electrons or generated X-rays. The travelled distance d, or position on the surface of the target 100, may e.g. be determined by the particular deflector settings used for deflecting the electron beam. In the present example, the rate of change in the sensor signal (e.g. indicating the amount of X-ray radiation generated at different locations on the target) from a first, relatively constant level to a reduced or near-zero sensor signal is proportional to a first width $W_y$ of the beam spot $A_l$. As the beam spot $A_l$ then crosses a second edge (not shown), in a direction perpendicular to the first edge, the rate of increase in sensor signal is proportional to a second width $W_x$ of the beam spot $A_l$.

A similar procedure may be used for determining the correlation between the settings of the electron-optical means, such as the deflector, and the position of the electron beam relative to the target. This may be done by observing the sensor signal, as described above, for different settings of the electron-optical means and correlate the settings with the electron beam passing over the edges of the target 100.

The invention claimed is:

1. An X-ray source, comprising:

an X-ray target;

an electron source operable to generate an electron beam interacting with the X-ray target to generate X-ray radiation with an energy within the range 9 to 12 key;

wherein the X-ray target comprises:

a first element selected from a list consisting of trivalent elements;

a second element selected from a list consisting of pentavalent elements forming a compound with said first element;

a first region including the compound formed of the first and second material; and a second region supporting the first region;

wherein the first region generates X-ray radiation upon interaction with the electron beam, and heat conduction between the first and second region is dominantly phonon heat conduction.

2. The X-ray source according to claim 1, wherein the first region is at least one of: provided in the form of a layer on the second region, and at least partly embedded in the second region.

3. The X-ray source according to claim 1, wherein said list of trivalent elements comprises boron, gallium, and indium.

4. The X-ray source according to claim 1, wherein said list of pentavalent elements comprises nitrogen, arsenic, and phosphorous.

5. The X-ray source according to claim 1, wherein said compound is selected from a list including gallium nitride, boron arsenide, indium arsenide, gallium phosphide, indium gallium nitride and gallium arsenide.

6. The X-ray source according to claim 1, wherein the second region comprises beryllium oxide or diamond.

7. The X-ray source according to claim 1, wherein the first region and the second region is separated by an edge, wherein said X-ray source further comprises:

an electron-optical means for scanning the electron beam over the edge;

a sensor adapted to measure a time evolution of a quantity indicative of the interaction between the electron beam and the first region and between the electron beam and the second region as the electron beam is being scanned over the edge; and a controller operably connected to the sensor and the electron-optical means and adapted to determine a lateral extension of the electron beam along the scanning direction, based on the measured time evolution of the quantity and a scanning speed of the electron beam.

8. The X-ray source according to claim 1, further comprising a target holder arranged to fixate said target.

9. The X-ray source according to claim 8, wherein said target holder comprises a path for a coolant arranged to remove excess heat from said target.

10. The X-ray source according to claim 9, wherein said target holder further comprises at least one of a heat exchanger, a cooling flange, a Peltier element, and a fan arranged to remove heat from a coolant.

11. The X-ray source according to claim 1, further comprising an X-ray optic arranged to form a monochromatic X-ray beam directed to a sample position.

* * * * *